US006547898B2

(12) United States Patent
Mignard et al.

(10) Patent No.: US 6,547,898 B2
(45) Date of Patent: Apr. 15, 2003

(54) METHOD OF MAKING SAFE A HEAT TREATMENT ENCLOSURE OPERATING UNDER A CONTROLLED ATMOSPHERE

(75) Inventors: François Mignard, Mennecy (FR); Runmeng Song, Nandy (FR); Stéphane Mehrain, Massy (FR)

(73) Assignee: Stein Heurtey, Ris-Orangis (FR)

( * ) Notice: Subject to any disclaimer, the term of this patent is extended or adjusted under 35 U.S.C. 154(b) by 0 days.

(21) Appl. No.: 09/854,520

(22) Filed: May 15, 2001

(65) Prior Publication Data

US 2001/0045024 A1 Nov. 29, 2001

(30) Foreign Application Priority Data

May 25, 2000 (FR) ..... 00 06708

(51) Int. Cl.[7] ..... C21D 1/613
(52) U.S. Cl. ..... 148/633; 266/110
(58) Field of Search ..... 266/103, 110; 148/627, 633; 432/242

(56) References Cited

U.S. PATENT DOCUMENTS 2,534,973 A * 12/1950 Ipsen et al. ..... 266/110
5,798,007 A * 8/1998 Boyer et al. ..... 148/627
6,190,164 B1 * 2/2001 Ueno et al. ..... 432/242

* cited by examiner

*Primary Examiner*—Scott Kastler
(74) *Attorney, Agent, or Firm*—Connolly Bove Lodge & Hutz LLP

(57) ABSTRACT

Method of making safe a heat treatment enclosure operating under a gas atmosphere, the said enclosure comprising a cooling chamber for rapidly cooling a metal strip running from an upstream chamber to a downstream chamber by means of a plurality of guide rollers, wherein said rapid cooling chamber is filled with a controlled atmosphere with a high hydrogen content and said strip is confined within said rapid cooling chamber by means of at least one pressure-balancing duct and of a plurality of gas locks placed between the various chambers, the pressures of the gas atmospheres between the chambers being balanced by means of ducts controlling the flow rates of the gas flowing through the said gas locks.

7 Claims, 4 Drawing Sheets

METHOD OF MAKING SAFE A HEAT TREATMENT ENCLOSURE OPERATING UNDER A CONTROLLED ATMOSPHERE

FIELD OF INVENTION

The present invention relates to a method of making safe a heat treatment enclosure operating under a controlled atmosphere. It relates more particularly to a method of making safe a treatment enclosure operating under an atmosphere having a high hydrogen content.

According to another aspect of the invention, it also relates to a heat treatment plant, especially one such as the enclosures encountered in the field of vertical furnaces for the continuous heat treatment or coating of metal strip.

BACKGROUND OF THE INVENTION

Continuous heat treatment furnaces, such as for example annealing or coating furnaces, are composed of one or more of the following zones: preheating, heating, soaking, slow-cooling and rapid cooling.

Each of these zones makes it possible to heat the strip, maintain its temperature or cool it with precise heating and cooling rates and for precise times defined by the metallurgical treatment cycle corresponding to the material to be treated.

New grades of steel recently developed have required new treatment cycles to be defined with new heating and cooling rates.

The high cooling rates dictated by these new cycles are obtained by increasing the pressure of the cooling gas blown onto the strip or by optimizing the blowing geometry so as to obtain the highest possible gas/strip exchange coefficients. The equipment used at the present time with low hydrogen contents show that the maximum rates that can be achieved in cooling are about 60° C./second for a strip 0.8 mm in thickness, above which rates the dimensions, the power absorbed by the fans and the cost of the plant become too great or the excessive gas blowing velocities cause instability in the position of the strip. To achieve these cooling rates it is also possible to limit the velocity of the line, but this correspondingly limits its production and makes this technique unprofitable.

To increase the performance in the cooling zones requires the use of an atmosphere with a high hydrogen content, up to 100%, so as to obtain a large increase in the exchange coefficient capable of generating cooling rates of about 80 to 200° C./second or more, for a strip 0.8 mm in thickness, these being compatible with the treatment cycles to be obtained at the nominal line speed.

The method of control allowing the percentage concentration of hydrogen to be increased to such values poses a major problem owing to the nature of this gas (especially the explosive character of this gas); in particular, it is impossible to use such an atmosphere throughout the line where contact with air in the strip entry and exit zones would entail major risks for the operating safety of the plant. It is therefore necessary to limit the zone operating with a high hydrogen content to the rapid cooling zone and to isolate this zone from the adjacent zones of the line where a reduced hydrogen content is sufficient for the treatment process and to ensure the operating safety of the line.

This operating safety must be ensured:

during nominal or stabilized operation of the line;

during changes to the line speed or to the strip format or when incidents occur, such as for example line shutdown or strip breakage.

These various line operating conditions result in pressure variations in the chambers, variations which are amplified by the considerable expansion or contraction of the atmosphere containing a large amount of hydrogen, causing an atmosphere to flow from one chamber to another. This changes the composition of the atmosphere and may entail major risks if the zone with a high hydrogen content is not controlled.

The operating method allowing such cooling or heating rate gradients to be obtained forms the subject matter of French Patent Application No. 2 746 112 filed by the Applicant.

BRIEF DESCRIPTION OF THE INVENTION

The solutions provided by the method forming the subject of the invention and the plant allowing such a method to be implemented offer a response to these safety problems, while reconciling requirements relating to atmosphere exchange control. These requirements also make it possible to optimize the operation of the heat treatment plant and to reduce the consumption of the controlled atmosphere (especially hydrogen) during nominal operation of this line or when there is a change in its speed or in the format of the strip to be treated, or when there is a production incident such as, for example, line shutdown or strip breakage.

For this purpose, the method of making safe a heat treatment enclosure operating under a gas atmosphere, the said enclosure comprising a chamber for rapidly cooling a metal strip running from an upstream chamber to a downstream chamber by means of a plurality of guide rollers, is characterized in that the said strip is confined within the rapid cooling enclosure with the aid of at least one pressure-balancing duct and of a plurality of gas locks placed between the various chambers, and in that the pressures of the gas atmospheres between the chambers are balanced by means of ducts, by controlling the flow rates of the gas flowing through the said gas locks.

Further features and advantages of the present invention will become apparent from the description given below with reference to the appended drawings which show illustrative embodiments thereof, these being devoid of any limiting character. In the figures:

DETAILED DESCRIPTION OF THE INVENTION

Figure 1:
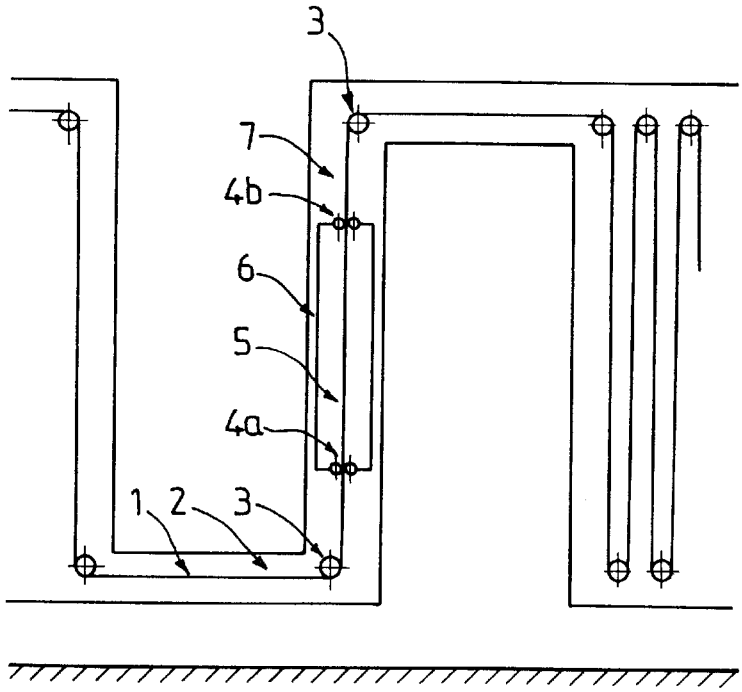
FIG. 1 is a sectional view in side elevation of a first embodiment of a heat treatment plant implementing the method forming the subject of the invention.

According to a first embodiment of a heat treatment plant allowing implementation of the method forming the subject of the invention (refer to FIG. 1), this plant comprises a vertical furnace for the continuous treatment of a metal strip 1 running from an upstream chamber 2 to a downstream chamber 7 over guide rollers 3.

A rapid cooling chamber, shown by 5, is equipped with state-of-the-art cooling devices (not shown in the figure) for blowing gas onto the strip.

The rapid cooling chamber 5 is separated from the upstream chamber 2 and the downstream chamber 7 by sealing devices 4*a* and 4*b* such as gas locks, gas locks with flaps, gas locks with rollers, gas curtains, or other devices according to known technologies.

According to one advantageous feature of the invention, this consists in confining a portion of the strip which is intended to undergo a heat treatment, especially such as rapid cooling, in a duct 6. This duct 6 is positioned within the rapid cooling chamber 5 and is filled with a controlled atmosphere with a high hydrogen content.

According to another advantageous feature of the invention, the duct 6 located in the cooling chamber 5 also ensures that there is communication between the chambers 2 and 7 so as to balance the pressures.

The pressure in the high-content, especially high-hydrogen-content, chamber 5 can be maintained by controlling the leakage rate of this atmosphere through the gas locks 4*a* and 4*b*.

The high hydrogen content of this leakage may be diluted in the atmosphere of the chambers 2 and 7, behaving as a hydrogen top-up for these chambers.

Atmosphere injection is therefore limited in this part of the furnace to topping up the zone 5, the zones 2 and 7 being topped up by the controlled leakage flow rates of the gas locks 4*a* and 4*b*.

The hydrogen pressures and contents of the chambers 2, 5, 6 and 7 are monitored by sensors and a regulating device which adjusts the amounts of atmosphere top-up so as to maintain these pressures and the compositions of the various atmospheres in the various chambers at their required values.

According to a second embodiment of a heat treatment plant allowing implementation of the method forming the subject of the invention (refer to FIG. 2), this plant differs from that shown in FIG. 1 by the fact that the rapid cooling chamber 5, which is exposed to a controlled gas atmosphere, incorporates both an ascending run and a descending run of the metal strip.

This configuration means that the gas locks 4*a* and 4*b* have to be placed at the same height so that the gas pressures, upstream and downstream of the gas locks, are identical (same mass of the gas column). The cooling equipment is distributed over one or both runs or different or complementary heating-cooling equipment is fitted along the second run of the strip.

In order to balance the gas pressure prevailing within the confinement chamber 5 at the gas locks 4*a* and 4*b*, a balancing duct 8 has been added to the plant.

In a manner similar to the first embodiment of the heat treatment plant, a duct 6 encloses the confinement chamber 5, forming an envelope around it which is linked both to the chamber 2 and the chamber 7. This duct 6 therefore brings the atmospheres prevailing within these chambers into communication and helps to balance the pressures.

Figure 2:
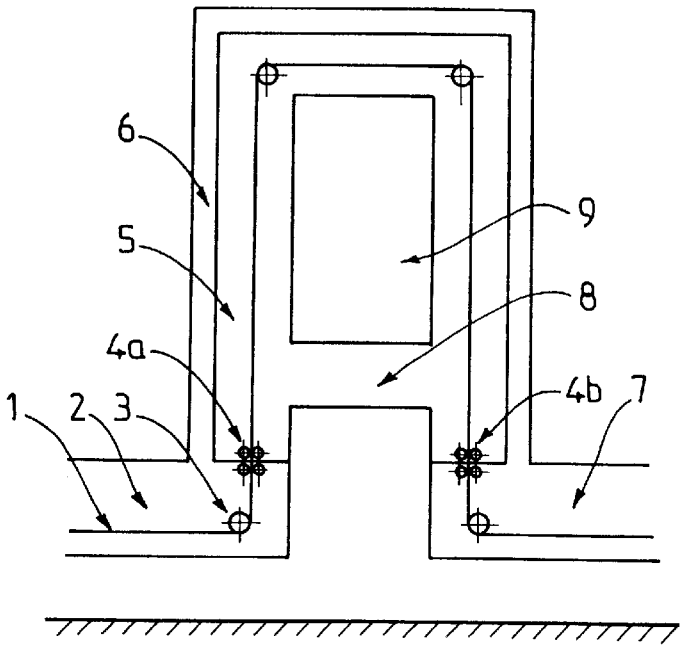
FIG. 2 is a sectional view in side elevation of a second embodiment of a heat treatment plant implementing the method forming the subject of the invention.

It will be seen in this FIG. 2 that the zone with a high hydrogen content is a dead end and that the two sides of the gas locks 4*a* and 4*b* are at an identical pressure owing to the balancing ducts 6 and 8. This arrangement limits the gas flows between the zone 5 and the adjacent zones 2 and 7 of the plant. This limits the sources of gas flow between these zones and therefore the flow rates of top-up gas, especially hydrogen, necessary for maintaining this balance.

The improvement in the quality of the separation of the atmospheres between the chamber 5 and the adjacent chambers 2 and 7 allows higher hydrogen contents to be used in the chamber 5 and therefore achieves exchange coefficients and cooling rates which are much higher than those obtained with the prior state of the art.

Figure 3:
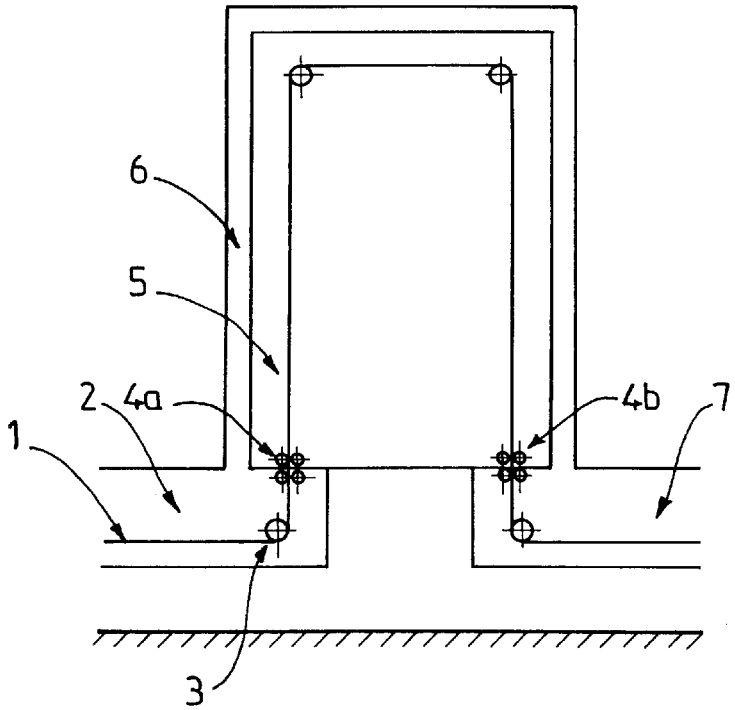
FIG. 3 is a sectional view in side elevation of a third embodiment of a heat treatment plant implementing the method forming the subject of the invention.

A part 9 located approximately in the centre of the plant and in the upper part of the duct 8 is particularly reserved for installing the equipment (tubing, control valves, etc.) for blowing onto the strip. If the construction so allows, this part may be omitted, the chamber 5 then possibly being produced as shown in FIG. 3.

According to a third embodiment of a heat treatment plant allowing the method forming the subject of the invention to be implemented (refer to FIG. 4), this plant comprises a vertical furnace for the continuous treatment of a metal strip 1 running from an upstream chamber 2 to a downstream chamber 7 over guide rollers 3.

A rapid cooling chamber, shown by 5, is equipped with state-of-the-art cooling devices (not shown in the figure) for blowing gas onto the strip.

The rapid cooling chamber 5 is separated from the upstream chamber 2 and the downstream chamber 7 by sealing devices 4*a* and 4*b* such as gas locks, gas locks with flaps, gas locks with rollers, gas curtains, or other devices according to known technologies.

Figure 4:
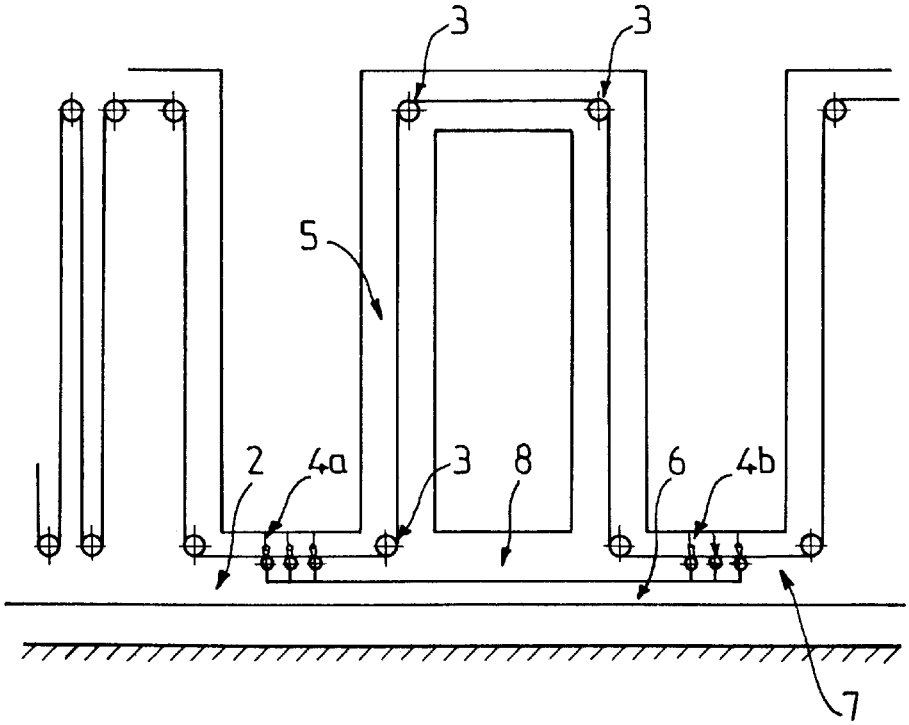
FIG. 4 is a sectional view in side elevation of a fourth embodiment of a heat treatment plant implementing the method forming the subject of the invention.

As may be seen in FIG. 4, the sealing gas locks 4*a* and 4*b* are placed horizontally upstream and downstream respectively of the rapid cooling chamber 5, and make it possible to define, in an approximately horizontal direction, a duct 6 which brings the adjacent chambers 2 and 7 into communication, and consequently helping, as in the case of the previous embodiments, to balance the gas pressures prevailing within these chambers.

Likewise, communication between the gas locks 4*a* and 4*b* and the lower part of the chamber 5 is achieved with the aid of a balancing duct 8.

As in the case of the second embodiment and if the construction of the elements for blowing gas onto the strip so allows, the ascending and descending runs of the strip may be combined in a single chamber as shown in FIG. 3.

According to a fourth embodiment of a heat treatment plant allowing the method forming the subject of the invention to be implemented (refer to FIG. 5), this plant includes means for making safe the high-hydrogen-content atmosphere in the cooling chamber. For this purpose, this plant comprises three ducts for balancing the pressures between the various points in the chambers of the treatment line.

The high-hydrogen-content chamber 5 is fitted with a first balancing duct 8 so as to keep the same pressure at the isolating gas locks 4*a* and 4*b*. A second balancing duct 10 is used to keep the pressures of the gas locks at the same level.

Finally, a third balancing duct 6 makes it possible to keep the pressures of the upstream and downstream chambers 2 and 7 at the same level and allows free circulation of the gas flows between these upstream and downstream zones without disturbing the pressure regime of the gas locks and of the high-hydrogen-content chamber 5.

The pressures and content in the various chambers, especially of hydrogen, are measured continuously and suitable atmosphere top-ups are made in these various chambers so as to keep the hydrogen pressures and contents constant therein. Points for withdrawing atmosphere may be made in each of these zones or in the pressure-balancing ducts, so as to allow discharge of a parasitic flow between two zones which could disturb the atmosphere therein.

The atmosphere extracted from the high-hydrogen-content chamber may be treated outside the line or may be used directly in this line, after injecting nitrogen in order to recreate an atmosphere with a low hydrogen content. This process allows the total hydrogen consumption of the line to be appreciably reduced.

Figure 5:
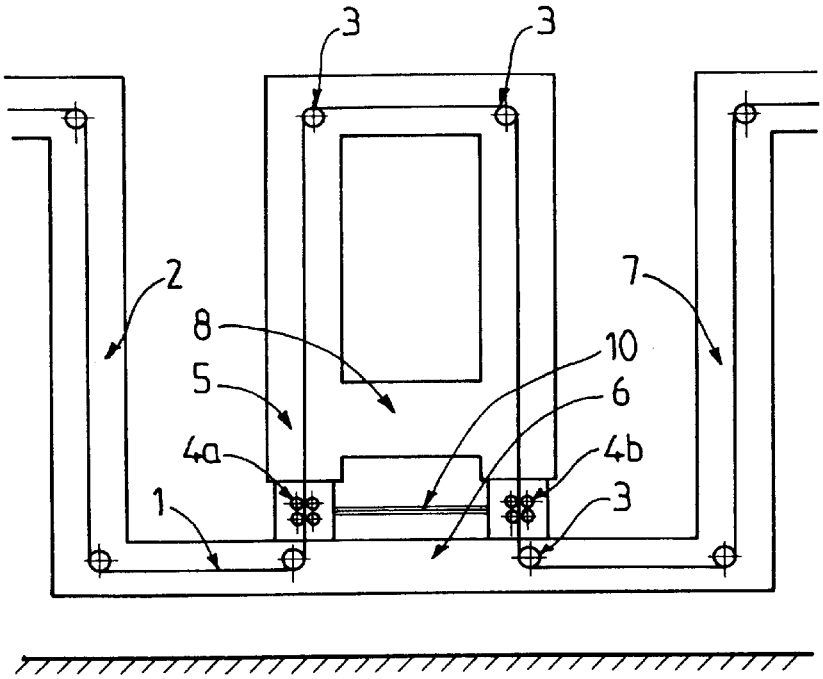
FIG. 5 is a sectional view in side elevation of a fifth embodiment of a heat treatment plant implementing the method forming the subject of the invention.
Figure 6:
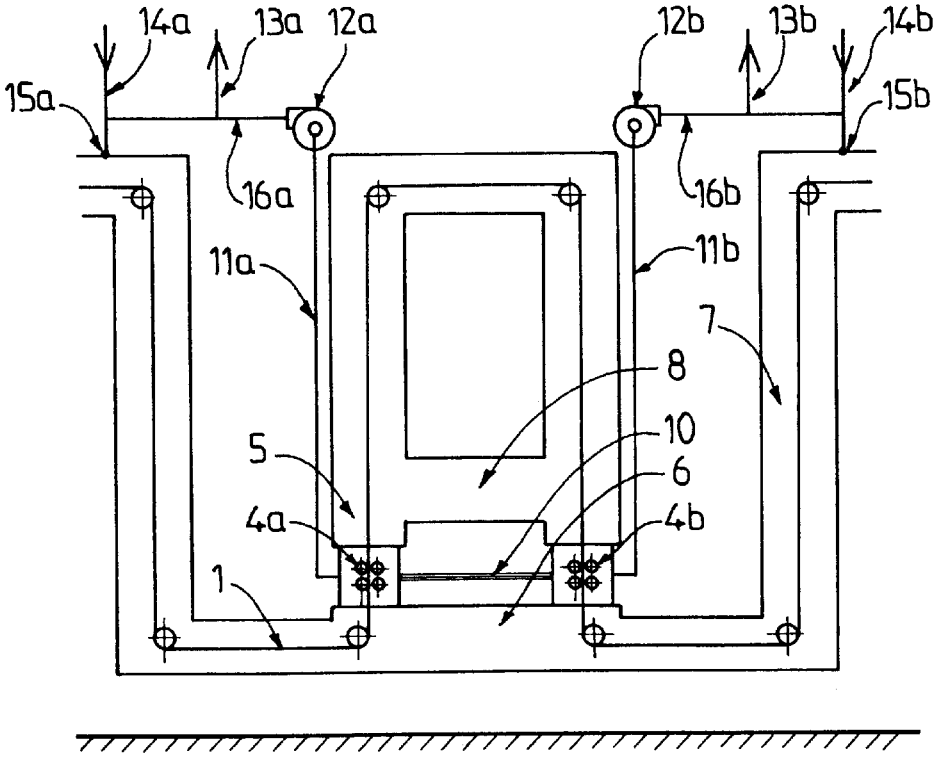
FIG. 6 is a sectional view in side elevation of a sixth embodiment of a heat treatment plant implementing the method forming the subject of the invention.

According to a fifth embodiment of a heat treatment plant allowing the method forming the subject of the invention to be implemented (refer to FIG. 6), this plant is similar in its design to that shown in FIG. 5 (it has three pressure-balancing ducts), but differs in that it includes means allowing the atmosphere extracted from the high-hydrogen-content chamber to be recycled.

First pipes 11*a* and 11*b* are connected to points for extracting the high-hydrogen-content atmosphere which are preferably located near the gas locks 4*a* and 4*b*. Extraction devices, for example fans 12*a* and 12*b*, convey the said atmosphere and send it via second pipes 16*a* and 16*b* either to a zone 13*a* or 13*b* for discharge outside the plant, or to a zone 14*a*, 14*b* for diluting it with a gas top-up mixture (especially nitrogen) so as to obtain an atmosphere whose hydrogen content is lowered to a value corresponding to the hydrogen content of the upstream zone 2 and the downstream zone 7, in which zones the diluted-gas injection points are made at 15*a* and 15*b*.

It will be understood that these gas recycling means may be adapted so as to collect the flow of atmosphere with a high hydrogen content at the various points of the chamber 5 or of the gas locks 4*a* and 4*b*, so as to limit the exchanges of atmospheres between the chamber 5 and the adjacent chambers 2, 7.

These recycling means also make it possible to recover the flows of high-hydrogen-content atmosphere so as to dilute them down to a value corresponding to the atmospheres of the upstream and downstream zones.

These recovered flows may be injected at various points into the upstream or downstream zones of the plant so as to keep their pressures constant and to limit the flows of top-up atmosphere to be injected into the plant, thus helping to make this plant safe while reducing the total hydrogen consumption of the line.

These recycling means make it possible, on the one hand, to ensure that the atmosphere of the high-hydrogen-content chamber 5 is separated from the atmospheres of the neighbouring chambers and, on the other hand, to recover the extracted flows involved.

Thus, it is possible to keep the rapid cooling chamber 5 at a constant pressure, including during the transient operating phases of the line. Reinjecting the extracted flows makes it possible to limit, on the one hand, the top-up flows to be delivered by the line production control unit and, on the other hand, the cost of producing this atmosphere during operation of the said line.

These recycling means also make it possible to dispense with the atmosphere mixing control unit fitted on the line by replacing it with an injection of hydrogen into the rapid cooling zone 5 and with extraction means 12*a*, 12*b* and mixing means 14*a*, 14*b* allowing:

recovery of the flows withdrawn from the various points of the zones;

their dilution down to a low hydrogen content in order to be reinjected into the other zones of the plant.

Separation of the atmosphere in the rapid cooling zone 5 is therefore achieved without the flows extracted from its various zones being lost. This limits the operating cost of the plant.

Figure 7:
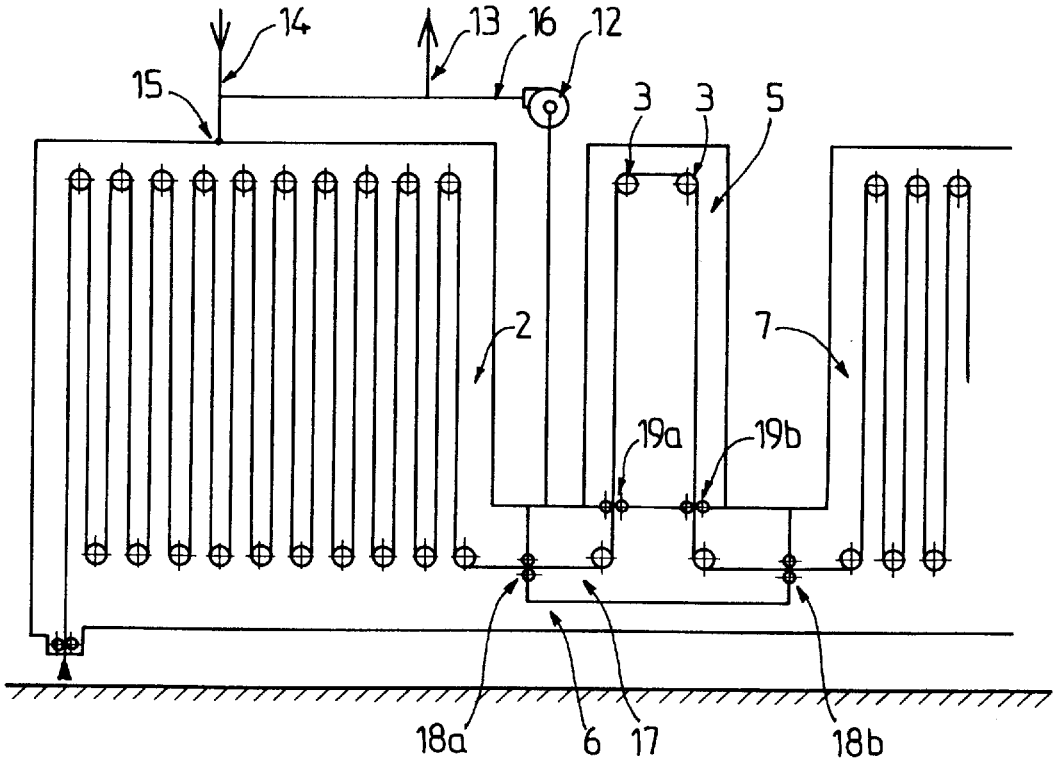
FIG. 7 is a sectional view in side elevation of a seventh embodiment of a heat treatment plant implementing the method forming the subject of the invention.

According to a sixth embodiment of a heat treatment plant allowing the method forming the subject of the invention to be implemented (refer to FIG. 7), this plant, which is overall similar to the previous ones, is distinguished by the fact that it has a single pressure-equalizing chamber 17.

The gas locks 4*a* and 4*b* and their pressure-balancing duct 6 have been extended sufficiently so as to compose this equalizing chamber 17, the latter being, on the one hand, separated from the high-hydrogen-content chamber 5 by the gas locks 19*a* and 19*b* and, on the other hand, from the upstream chamber 2 by the gas lock 18*a* and from the downstream chamber 7 by the gas lock 18*b*. A pressure-balancing duct 6 joins these upstream and downstream chambers together. An atmosphere extraction, dilution and reinjection means, as described in the fifth embodiment, is shown schematically at 12, 13, 14, 15 and 16.

The volume of the chamber 17 makes it possible to damp the pressure variations between the chamber 5 and the upstream 2 and downstream 7 chambers and to compensate for these pressure variations by means of an atmosphere injection or of extraction means.

Figure 8:
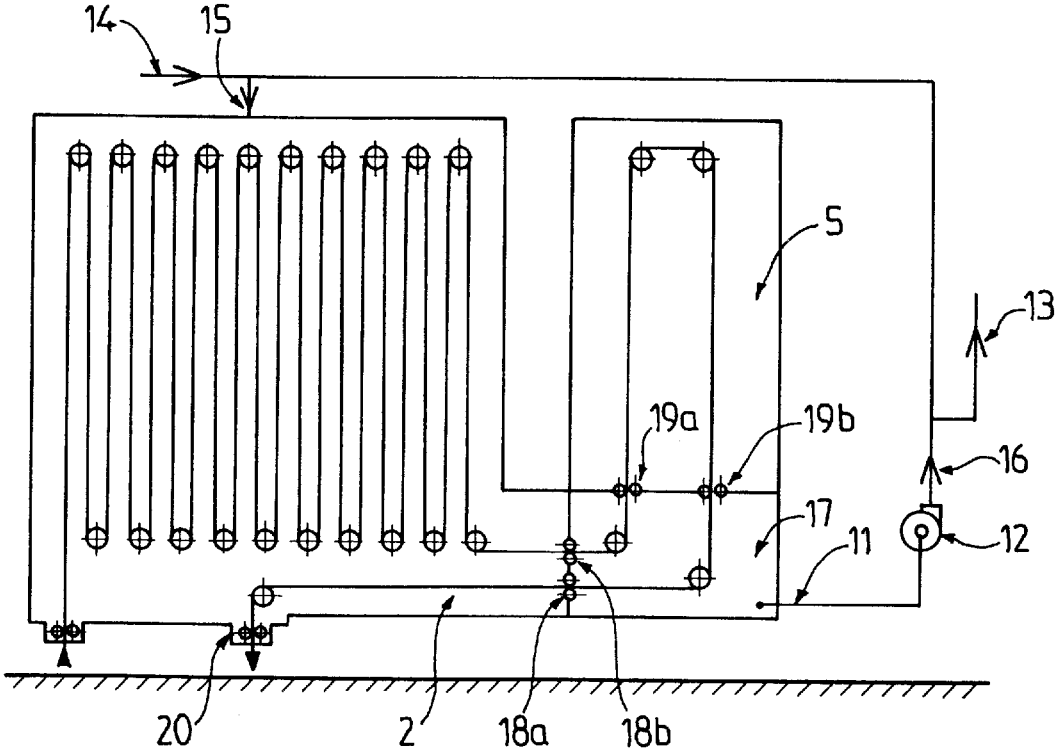
FIG. 8 is view similar to FIG. 7, showing a variant of the invention.

According to a seventh embodiment of a heat treatment plant allowing the method forming the subject of the invention to be implemented (refer to FIG. 8), if the chamber under an atmosphere with a high hydrogen content is located at the end of the line and there is no other chamber downstream, this plant is similar overall to the sixth plant (refer to FIG. 7) but is distinguished from it by the fact that the downstream chamber is omitted and the exit for the strip 21 is located in the enclosure 2 so as to distance it from the zone with a high hydrogen concentration.

The invention as described above offers many advantages:

separation of a high-hydrogen-content chamber from the adjacent chambers makes it possible to limit the atmosphere flows or contaminations between these various chambers by fitting pressure-balancing ducts;

recovery of the flows extracted at the various points of the plant during variations in the operating conditions of the line or during production incidents allows these flows to be reinjected into the line, thus limiting the consumption by the plant of the various types of atmosphere;

the possibility, owing to the better control of the isolation of the high-hydrogen-content chamber, of using $H_2$ concentrations greater than 50%, preferably 75%, thus making it possible to improve the exchange coefficients and to obtain cooling rates not hitherto achieved by the plants known from the prior art;

reduction in the strip's treatment cost, obtained by reducing the hydrogen consumption of the line;

compensating for the differences in pressure in the chambers during production incidents results in a reduction in the contamination of the atmospheres in the various chambers of the line;

the better quality of the treated product, by maintaining the gas/strip exchange coefficients in the various chambers, stems from maintaining the hydrogen concentrations in the various zones of the line;

elimination of the central atmosphere mixing control unit, replaced with mixing units located on the plant, results in recirculation of the high-hydrogen-content flows extracted from the sealing devices of the zone 5 and their dilution before being reinjected into the various zones of the plant.

It will, of course, be understood that the present invention is not limited to the illustrative embodiments described and shown above, rather it encompasses all the variants thereof.

What is claimed is:

1. A method for increasing the safety of a heat treatment enclosure operating with a gas atmosphere, the enclosure including a cooling chamber for rapidly cooling a metal strip running from an upstream chamber to a downstream chamber by means of a plurality of guide rollers, wherein the rapid cooling chamber is filled with a controlled atmosphere of high hydrogen content, the method comprising the steps:

providing a plurality of gas locks at an inlet an outlet of the rapid cooling chamber;

providing at least one first pressure balancing duct between the inlet and outlet of the rapid cooling chamber; and providing a second pressure balancing duct between the upstream and downstream chambers;

wherein the first and second ducts balance the gas atmospheres between the upstream, downstream, and rapid cooling chambers thereby controlling the flow rate of gas flowing through the gas locks.

2. The method according to claim 1, wherein atmosphere is extracted from the high-hydrogen content cooling chamber at extraction points located near the gas locks and is discharged through an exterior port.

3. The method according to claim 1, wherein atmosphere is extracted from the high-hydrogen content cooling chamber at extraction points located near the gas locks and is conveyed to a zone for dilution with a gas top-up mixture so as to obtain an atmosphere whose gas, especially hydrogen content, is lowered to a value corresponding to the hydrogen content of the upstream and downstream zones.

4. The method according to claim 1, wherein flows from the high-hydrogen content cooling chamber are extracted and are injected at preselected points of the upstream and downstream chambers so as to keep their pressures constant and to limit the atmosphere top-up flows to be injected into the upstream and downstream chambers from an external source.

5. The method according to claim 1, wherein the flow of high-hydrogen content atmosphere is collected at a plurality of preselected points in the rapid cooling chamber and at the gas locks so as to limit the exchange of atmosphere gas between the cooling chamber and the upstream and downstream chambers.

6. A plant for increasing the safety of a heat treatment enclosure operating with a gas atmosphere, the enclosure including a cooling chamber for rapidly cooling a metal strip running from an upstream chamber to a downstream chamber by means of a plurality of guide rollers, wherein the rapid cooling chamber is filled with a controlled atmosphere of high hydrogen content, the plant comprising:

a plurality of gas locks at an inlet and an outlet of the rapid cooling chamber;

at least one first pressure balancing duct between the inlet and outlet of the rapid cooling chamber;

and a second pressure balancing duct between the upstream and downstream chambers;

wherein the first and second ducts balance the gas atmospheres between the upstream, downstream, and rapid cooling chambers thereby controlling the flow rate of gas flowing through the gas locks.

7. A plant according to claim 6, including a pressure-balancing duct connected between the gas lock located at the inlet of the rapid cooling chamber and the gas lock located at the outlet of the cooling chamber.

* * * * *